United States Patent [19]

Dove

[11] 4,444,622

[45] Apr. 24, 1984

[54] STEAM DISTRIBUTION

[75] Inventor: Norman F. Dove, North Vancouver, Canada

[73] Assignee: Devron Engineering Ltd., Canada

[21] Appl. No.: 384,792

[22] Filed: Jun. 4, 1982

Related U.S. Application Data

[63] Continuation of Ser. No. 191,373, Sep. 29, 1980, abandoned, which is a continuation-in-part of Ser. No. 144,303, Apr. 28, 1980, abandoned, which is a continuation of Ser. No. 924,399, Jul. 14, 1978, abandoned.

[51] Int. Cl.[3] ..... D21F 5/00

[52] U.S. Cl. ..... 162/207; 162/290; 34/16; 34/23; 34/34; 34/160; 239/139; 239/557; 239/568

[58] Field of Search ..... 162/207, 290; 34/16, 34/23, 34, 155, 160, 227, 228; 239/139, 553.3, 557, 568, 191, 373

[56] References Cited

U.S. PATENT DOCUMENTS

| | | | |
|---|---|---|---|
| Re. 28,968 | 9/1976 | Dove | 162/290 X |
| 3,199,222 | 8/1965 | Hultgreen | 34/155 |
| 3,284,285 | 11/1966 | Holden | 162/207 X |
| 3,574,338 | 4/1971 | Shelor | 239/557 X |
| 3,945,570 | 3/1976 | Dove | 239/139 X |

FOREIGN PATENT DOCUMENTS

| | | | |
|---|---|---|---|
| 47-34645 | 8/1972 | Japan | 162/290 |

*Primary Examiner*—Richard V. Fisher

*Attorney, Agent, or Firm*—Spensley, Horn, Jubas & Lubitz

[57] ABSTRACT

A steam distributor for applying steam to a paper sheet moving beneath it and spaced from the distributor. The distributor has a leading edge and a trailing edge relative to the sheet movement. There is a header for steam extending along the leading edge. At least one opening formed in the header enables steam to be directed towards the sheet. The steam so directed forms a curtain to eliminate air entrained by the sheet.

13 Claims, 10 Drawing Figures

Fig. 1.
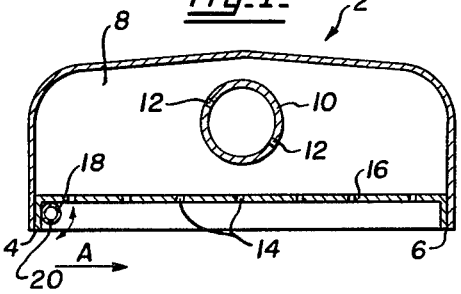
Fig. 2.
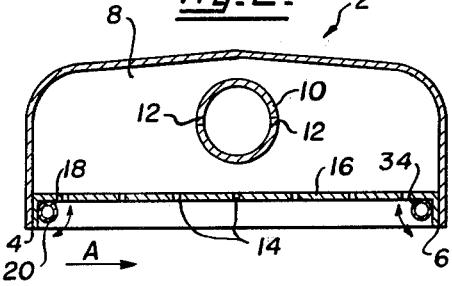
Fig. 7.
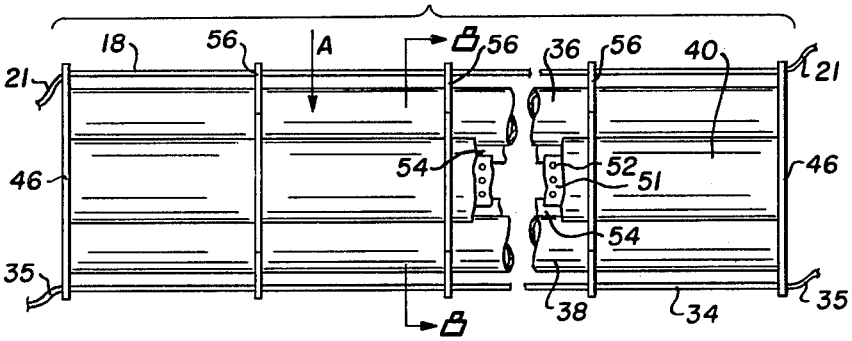
Fig. 8.
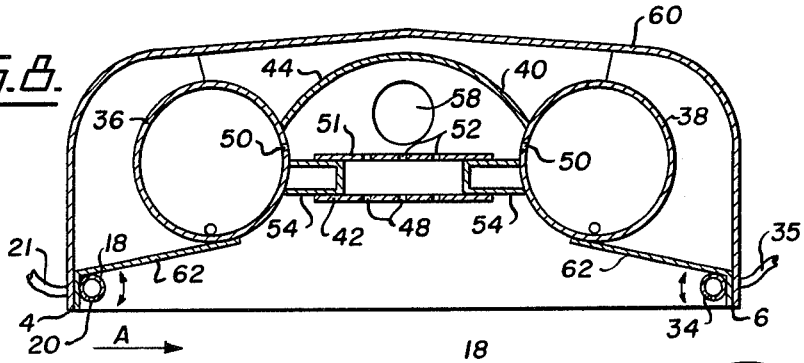
Fig. 6.
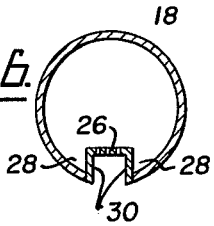
Fig. 4b.
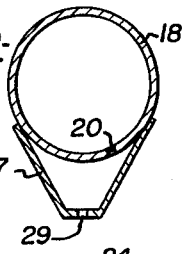
Fig. 5.
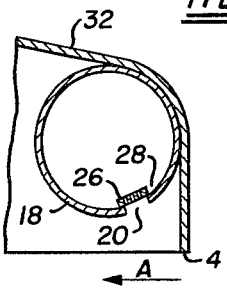
Fig. 4.
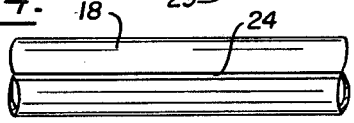
Fig. 3.
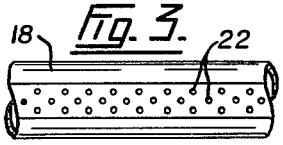
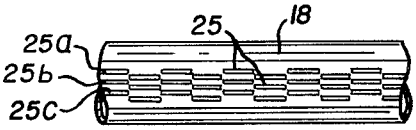
Fig. 4a.

STEAM DISTRIBUTION

CROSS REFERENCE TO RELATED APPLICATIONS

This is a continuation of application Ser. No. 191,373, filed Sept. 29, 1980, now abandoned, which is a continuation-in-part of application Ser. No. 144,303, filed Apr. 28, 1980, now abandoned, which is a continuation of Ser. No. 924,399 filed July 14, 1978, and now abandoned.

FIELD OF THE INVENTION

This invention relates to a steam distributor for applying steam to a paper sheet moving beneath it. The steam distributor of the present invention finds particular application in the paper making industry for applying steam to a paper sheet moving beneath it and spaced from the distributor.

DESCRIPTION OF PRIOR ART

Paper may be defined as a web of fibrous cellulosic materials. The cellulose fibers of the original raw materials from which the paper is made are first separated from each other by a mechanical or chemical pulping and then felted together to form the web. The paper is formed by suspending the cellulose fibers in water and forming a web from them. Water is drained from the web to produce the paper.

It is well established in the paper making industry that water can be made to drain from the paper sheet at a greatly increased rate by heating the sheet. Steam is frequently used and specific means of applying steam to a paper sheet are described and claimed in my earlier U.S. Pats. No. 3,777,781, issued Dec. 11, 1973, the reissue of that patent, Re 28968, reissued Sept. 21, 1976 and U.S. Pat. No. 3,945,570 issued Mar. 23, 1976.

When a steam heating device is utilized to heat the moving paper sheet, such as the paper making process on the paper making machine either fourdrinier and/or the press location, the significance of eliminating air from the available heating zone can not be over emphasized. The prime function of such a steam heating device is to heat the paper sheet. The available heat transfer is that which takes place during the change of state of steam to water, that is, the latent heat of the steam is transferred into sensible heat in the water. The major factor effecting the rate of heat transfer is therefore a function of the rate of steam condensation in the moving web. The presence of non-condensible gases, for example air, in steam can reduce the rate of steam condensation by a factor of greater than 4 to 1 and it is for this reason that it is imperative to provide a steam heating zone that is void of air.

It is not practical to contact the moving paper sheet directly with a mechanical seal hence a clearance must be provided between the bottom of the heating zone and the paper sheet. This clearance is normally about $\frac{3}{8}''$. It is via this clearance that air can pass into the heating zone. The quantity of air is of significant magnitude by virtue of the fact that an air boundary follows the sheet at a velocity close to that of the moving sheet. Consider the case for a standard machine of 240" width operating at a speed of 2500 fpm. For a $\frac{3}{8}''$ clearance the volume of air entering the heating zone would be about 1500 cfm. For the same machine (dependent upon grade) a typical theoretical steam usage could be in the order of 10,000 lb/hr. For such a machine the amount of air vs. steam is 32% by volume, or 64% by weight. Even for cases where the theoretical steam required is higher it can be readily seen that the volume of air under consideration is of significant magnitude.

In the past the negative effect of the air has been resolved primarily by deliberately spilling steam from the unit in order to "sweep away" the air boundary ahead of the steam heater. This approach has been effective in as far that higher sheet temperatures are accomplished but the heat transfer efficiency to the sheet is very poor due to the steam spillage. For example, efficiencies as low as 30% are not uncommon, the balance being lost to the machine room.

The problem of increasing sheet temperatures in the press section becomes more pronounced than, for instance, on the fourdrinier due to space limitations. That is, whereas a fourdrinier application may make a heating zone machine width of 60" practical, a press unit would normally have a heating zone width of in the order of 15". For a machine operating at 2500 fpm the retention time available for each 12" width of the steam heater is only 0.024 seconds. To keep air out of the available heating zone one method that has been tried, other than "spilling steam", is to equip the lead edge of the device with a mechanical labyrinth type seal. The problem with this method is that the efficiency is limited due to the fact that an air flow must exist before a restriction is accomplished which in itself necessitates an acceptance of air leakage, plus, of just as much significance, the configuration of the seal is such that it creates a place for fibres to accumulate. The problem could be quite severe since fibres do "break away" from the moving sheet and if allowed to accumulate on a stationary object, such as the seal, they would eventually build up to the point where they would interfere with the moving paper sheet.

The spillage of steam from the device and into the machine room makes for uncomfortable working conditions as well as being wasteful of steam. It is therefore further wasteful of energy in that the uncomfortable working conditions must be improved by air conditioning and the like.

It is known from Japanese Pat. No. 47-34645 to Tomioka to form an air curtain with compressed air in a heating apparatus in a paper machine. However, in the Tomioka patent a principal concern is to apply a heat source, which may be steam or heated air, to the paper sheet at increased pressure. It is alleged that the viscosity, surface tension and filter resistance of the pulp is reduced at increased pressure so that water removal occurs more easily. The air curtain of the Tomioka reference is thus applied in order to maintain the pressure within the open bottomed box where the application of the steam to the sheet actually occurs. However, there is no disclosure whatsoever in Tomioka of the use of a steam curtain and, indeed, although the air curtain may well permit the development of higher pressures within the box it is inevitable that air will be drawn into the box by the paper sheet with consequent marked disadvantages in the heat transfer to the paper sheet as discussed above.

SUMMARY OF THE INVENTION

Accordingly, the present invention seeks to provide a steam distributor that has associated with it means for providing what may be considered a steam curtain to prevent the ingress of air, carried by the paper sheet, into the heating zone.

In addition the steam curtain is extremely effective in preventing spillage of steam from out of the heating zone into the machine room.

Accordingly, in a first aspect, the present invention is in a steam distributor for applying steam to a web of cellulose fibers carried on a moving belt and spaced from the distributor, the distributor having a leading edge and a trailing edge relative to the belt movement, and is the improvement comprising a header for steam extending along said leading edge; means for supplying said header with steam; means defining a first row of spaced outlets for said steam arranged longitudinally on said header; means defining a second row of spaced outlets for said steam arranged longitudinally on said header; means defining a third row of spaced outlets from said steam arranged longitudinally on said header; each of said means defining said rows being such that the spaced outlets in each row are staggered relative to the spaced outlets in the neighbouring row; said header located on said distributor and positioned with respect to said web such that steam flowing out of said first, second and third rows of outlets is directed downwardly towards said belt at 90° to or against the direction of movement of the belt at the leading edge of the distributor and precludes air carried by said web from flowing past said header.

In a further aspect the present invention is in a method of applying steam to a paper sheet from a steam distributor positioned above the sheet, the distributor having a leading edge and a trailing edge relative to the movement of the paper sheet, and is the improvement that comprises directing steam downwardly from the leading edge of the distributor to prevent air being drawn into the distributor by the paper sheet.

In a preferred embodiment the method also comprises directing steam downwardly from a trailing edge of the distributor.

The header should be rotatable so that the angle of direction of the steam may be varied depending upon, for example, the paper grade in paper making and the speed of the sheet.

The openings in the header may comprise a plurality of substantially circular holes but, preferably, comprise a plurality of slots arranged in at least two rows, the slots in each row being staggered with regard to the slots in the other rows.

In a further desirable aspect the steam distributor includes a second header for steam at the trailing edge of the distributor. This second header is the same as the first header and, again, is preferably arranged to direct steam against the direction of movement of the belt, that is back into the steam distributor. Again it is desirable that the second header for steam be rotatable.

BRIEF DESCRIPTION OF THE DRAWINGS

Aspects of the invention are illustrated, merely by way of example, in the accompanying drawings in which:

FIG. 1 is a diagrammatic section illustrating a distributor according to the present invention;

FIG. 2 is a view similar to FIG. 1 illustrating a further aspect of the invention;

FIG. 3 illustrates one configuration of openings in the header useful in the distribution of the present invention;

FIG. 4 illustrates an alternative arrangement using a slot;

FIG. 4*a* illustrates a plurality of slots;

FIG. 4*b* illustrates a further form of header;

FIG. 5 illustrates the positioning of a header in a distributor according to the present invention;

FIG. 6 illustrates a header useful in the distributor of the present invention;

FIG. 7 is a plan view of a steam distributor; and

FIG. 8 is a section on the line 8—8 in FIG. 7.

DESCRIPTION OF THE PREFERRED EMBODIMENTS

FIG. 1 indicates the rudiments of the present invention and does not necessarily show a steam distributor that would be used in modern paper making. FIG. 1 illustrates a steam distributor 2 for applying steam to a sheet (not shown) moving beneath it. The sheet is spaced from the distributor. In all cases the arrow A indicates the direction of movement of the sheet underneath the distributor 2 when the distributor 2 is in use.

The distributor 2 has a leading edge 4 and a trailing edge 6, these terms being used relative to the belt movement as shown by the arrow A. The distributor as indicated in FIGS. 1 and 2 comprises a steam chamber 8 having a steam header 10 positioned within it. There are openings 12 in the header 10 so that steam supplied to the header 10 can pass to the chamber 8. Steam leaves the chamber 8 through openings 14 formed in the bottom wall 16. Steam leaving the openings 14 impinges on the paper sheet passing beneath it.

As illustrated in FIG. 1, according to the invention there is provided a header 18 for steam extending along the leading edge 4. There are openings 20 formed in the header to enable steam to be directed downwardly towards the belt. Typically the steam is directed against the direction of movement of the sheet at the leading edge 4 of the distributor 2 but, as indicated by the two-headed arrows, the header 18 should be rotatable so that the angle of application of the steam may be varied. As particularly illustrated in FIGS. 3 and 4 the openings 20 may comprise a plurality of substantially circular holes 22, preferably arranged isometrically, (FIG. 3) or as shown in FIG. 4, a single elongate slot 24. FIG. 4*a* illustrates the use of a plurality of staggered slots 25 arranged in three rows, 25*a*, 25*b* and 25*c*.

FIG. 4*b* shows the use of a separate chamber 27 attached to header 18. Openings 20 communicate with the interior of chamber 27. Chamber 27 has outlets 29. Steam issuing from outlets 29 forms a steam curtain.

The arrangement of FIG. 4*b*, in which header 18 acts as an intermediate chamber, smooths out steam pressure differences in the cross-machine direction to produce uniform steam flow from outlets 29.

As illustrated in FIGS. 5 and 6 the openings 20 may be positioned in an inset 26 arranged longitudinally and at the exterior of the header 18. The inset is positioned inwardly of the periphery of header 18 to provide a steam trap 28 at the edges of the inset 26. FIG. 6 in particular illustrates the formation of a substantial steam trap 28 by the provision of walls 30. The condensate or steam trap is particularly useful for when the distributor is being started up. Further the use of a rotating header 18 permits the header to be rotated at start-up to form a steam trap.

FIG. 5 also illustrates that the header is desirably located against a shroud 32 of the steam distributor.

FIG. 2 illustrates an aspect of the invention in which there is a second header 34 for steam at the trailing edge 6 of the distributor 2. The second header 34 may be precisely the same configuration as the first header 18. It is desirable that the steam from second header 34 be directed against the direction of movement of the sheet. Again, as indicated by the double headed arrows, second header 34, should also be rotatable. The second header 34 acts to provide a steam curtain to keep steam in the heating zone.

FIGS. 7 and 8 illustrate the present invention in association with a steam supply apparatus or distributor as described and claimed in my U.S. Pat. No. 3,945,570. The apparatus comprises a first pipe 36 and a second pipe 38 spaced from the first pipe 36. A cover 40 extends between the pipes 36 and 38 and is secured to the pipes. A bottom wall 43 is positioned below the cover 40, and extends longitudinally between the pipes 36 and 38. The pipes 36 and 38, the cover 40 and the bottom wall 42 form a steam chamber 44 between end members 46 to close steam chamber 44 near opposite ends of the pipes 36 and 38. These end members 46 are shown in FIG. 7. There are steam outlet means in the bottom wall 42 in the form of a plurality of holes 48 along the length of the bottom wall 42. A plurality of apertures 50 are arranged in each pipe longitudinally. These apertures 50 maintain the interiors of steam pipes 36 and 38 in communication with steam chamber 44. The apertures 50 are spaced above the horizontal pipes 36 and 38 to reduce the possibility of condensate passing through the apertures 50 into the steam chamber 44. The apparatus has means for feeding steam (not shown) to the pipes 36 and 38. Steam supply means will typically comprise an inlet pipe connected to one end of one of the pipes 36 and 38. At the end opposite the inlet pipe a connector pipe joins the pipes 36 and 38 so steam can be fed into one of the pipes through the inlet pipe and distributed to the other pipe through the connector pipe.

A further wall 51 is arranged above and spaced from the lower wall 42. This further wall 51 is provided with a plurality of holes 52 along its length. Walls 42 and 51 are located by attachments to projecting portions 54 one portion 54 projecting from each of the pipes 36 and 38.

Stiffeners 56 are provided extending across the steam chamber 44 secured to the pipes 36 and 38 and the cover 40. Where necessary the stiffeners 56 are provided with apertures 58 to permit communication between adjacent sections. The apparatus of FIGS. 7 and 8 is provided with an insulation cover 60 (shown only in FIG. 8) and flaps 62 (again only shown in FIG. 8) extend from the cover 60 to the lower parts of the pipes 36 and 38. The insulation cover 60, the flaps 62 and the exterior of the pipes 36 and 38 and of the cover 40 define a chamber that can be packed with an insulating material. The lower end of the apparatus of FIGS. 7 and 8, as shown particularly in FIG. 8, defines a shroud through which steam is applied to a web passing beneath the distributor in the direction of the arrow A. As indicated particularly in FIG. 8 the apparatus is, according to the present invention, provided with steam headers 20 and 34, at the leading edge and the trailing edges of the shroud. FIGS. 7 and 8 illustrate the use of flexible steam supply hoses, 21, to header 20 and 35 to header 34. The flexible hoses 21 and 35 do not interfere with the desirable rotation of headers 20 and 34.

FIGS. 7 and 8 are included to indicate the application of headers for steam at the leading and trailing edge of a modern steam distributor useful in paper making.

The form of the "steam curtain" is that of a narrow band of high velocity steam that impinges on the paper sheet across the entire width of the lead edge of the steam heater. The relative velocity of this wall of steam is such that it resists the velocity pressure of the air boundary. Depending on the paper velocity, one or more "steam curtains" would be used in series to provide a dynamic labyrinth effect, i.e. the velocity pressure of the air boundary would diminish as each "steam curtain" is passed through. The steam curtains can be spaced less than ½" centers of each other thereby leaving the greater part of the available heating zone void of non-condensible gases, usually air. The steam curtain can be developed by passing steam through staggered narrow slots or through staggered small holes. In both cases the object is to form a barrier with no clear line of sight through the barrier.

The benefit to be derived from a press type unit is that higher sheet temperatures can be accomplished with relatively narrow machine direction width units. This is a necessary requirement since space limitations limit the machine direction width, in most cases, to in the order of 15" (for 2500 rpm retention time is 0.03 seconds). High efficiency would be accomplished with minimum steam wastage.

For press applications the concept has been proven by production performance data that clearly shows that steam usage has been reduced by factors as great as 4 to 1 without any loss to the benefits derived from applying steam to the paper sheet. Several such units tested have accomplished 15% machine speedups from previous dryer limited conditions together with a net energy saving. It should also be noted that units of the old design not only use more steam but for the same application only accomplish in the order of 10% machine speedup.

When the "steam curtain" concept is used on fourdrinier application units the same order of magnitude of energy savings are accomplished. Several units have been tested, that replaced units of the old design, where energy savings are reflected in a 60% reduction in energy usage. Of further significance is the fact that the M.D. width of the heating zone can be reduced without any loss of available temperature increase. This benefit reflects in potential manufacturing cost saving.

It will be appreciated that there are a large number of methods of applying steam to produce a steam curtain. In particular it is emphasized that there is no restriction on the particular configuration of the header shown in the drawing. In a useful embodiment a circular pipe has proved useful through all manner of cross sections would be appropriate.

I claim:

1. In a steam distributor for applying steam to a web of cellulose fibers carried on a moving belt and spaced from the distributor, the distributor having a leading edge and a trailing edge relative to the belt movement, the improvement comprising:

a header for steam extending along said leading edge;

means for supplying said header with steam;

means defining a first row of spaced outlets for said steam arranged longitudinally on said header;

means defining a second row of spaced outlets for said steam arranged longitudinally on said header;

means defining a third row of spaced outlets for said steam arranged longitudinally on said header;

each of said means defining said rows being such that the spaced outlets in each row are staggered relative to the spaced outlets in the neighbouring row; and said header located on said distributor and positioned with respect to said web such that steam flowing out of said first, second and third rows of outlets is directed downwardly towards said belt at 90° to or against the direction of movement of the belt at the leading edge of the distributor and precludes air carried by said web from flowing past said header.

2. A steam distributor as claimed in claim 1 including means to rotate said header to vary the angle of direction of the steam.

3. A steam distributor as claimed in claim 1 in which the means defining rows of spaced outlets define rows of spaced slots.

4. A steam distributor as claimed in claim 1 in which the means defining said rows of spaced outlets are positioned in an insert arranged longitudinally and at the exterior of the header for steam but set inwardly of the periphery to provide a condensate trap at the edges of the inset.

5. A steam distributor as claimed in claim 1 including a second header for steam at the trailing edge of the distributor;

means defining a first row of spaced outlets for said steam arranged longitudinally on said second header;

means defining a second row of spaced outlets for said steam arranged longitudinally on said second header;

means defining a third row of spaced outlets for said steam arranged longitudinally on said second header;

each of said means defining said rows being such that the spaced outlets in each row are staggered relative to the spaced outlets in the neighbouring row;

whereby steam may be directed downwardly towards said belt and against the direction of movement of the belt at the trailing edge of the distributor.

6. A steam distributor as claimed in claim 5 including means to rotate said second header to vary the angle of direction of the steam.

7. A steam distributor as claimed in claim 1 in which the header has first and second compartments; means defining openings in the first compartment communicating with the interior of the second compartment; and means defining openings in the second compartment to enable steam to be directed towards the belt, whereby uniform steam flow is enhanced.

8. A steam distributor for applying steam to a paper web travelling beneath it and spaced beneath the distributor, the distributor having a leading edge and a trailing edge relative to the paper web movement, means to supply steam to the steam distributor;

outlets in the distributor so that the steam may be directed downwardly onto the paper web;

a first header for steam extending along the leading edge of the distributor;

means defining a first row of spaced outlets for said steam arranged longitudinally on said header;

means defining a second row of spaced outlets for said steam arranged longitudinally on said header;

means defining a third row of spaced outlets for said steam arranged longitudinally on said header;

each said means defining said rows being such that the spaced outlets in each row are staggered relative to the spaced outlets in the neighbouring row;

said first header located on said distributor and positioned with respect to said web such that steam flowing out of said first, second and third rows of outlets is directed downwardly towards said belt and against the direction of movement of the belt at the leading edge of the distributor and precludes air carried by said web from flowing past said first header;

a second header for steam extending along said trailing edge of the steam distributor;

means defining a first row of spaced outlets arranged longitudinally on said second header;

means defining a second row of spaced outlets arranged longitudinally on said second header;

means defining a third row of spaced outlets arranged longitudinally on said second header;

each of said means defining said rows in said second header being such that the spaced outlets in each row are staggered relative to the spaced outlets in the neighbouring row; and said second header located on said distributor and positioned with respect to said web such that steam flowing out of said first, second and third rows of outlets is directed downwardly towards said belt and against the direction of movement of the belt at the trailing edge of the distributor so as to maintain said steam within the steam distributor.

9. In a method of applying steam to a paper sheet from a steam distributor positioned above and spaced from the sheet, the distributor having a leading edge spaced from the sheet and a trailing edge spaced from the sheet relative to the movement of the paper sheet, the improvement that comprises directing steam downwardly from the leading edge of the distributor in the form of a steam curtain to prevent air from being conveyed into the distributor by the paper sheet.

10. A method as claimed in claim 9 further including directing steam downwardly from the trailing edge of the distributor.

11. A method as claimed in claim 9, including varying the angle of the application of the steam.

12. In a method of applying steam to a paper sheet from a steam distributor positioned above and spaced from the sheet the distributor having a leading edge spaced above the sheet and a trailing edge spaced above the sheet relative to the movement of the paper sheet, the improvement that comprises directing steam downwardly from the leading edge of the distributor from a plurality of openings arranged in a plurality of rows, the arrangement being such that the steam presents a solid curtain to prevent air from being conveyed into the distributor by the paper sheet.

13. A method as claimed in claim 12, in which the openings are a plurality of holes arranged on isometric centers.

* * * * *